US006752732B2

(12) United States Patent
Morrison et al.

(10) Patent No.: US 6,752,732 B2
(45) **Date of Patent: *Jun. 22, 2004**

(54) BASKETBALL HAVING NINE TO TWELVE COVER PANELS

(75) Inventors: Stan W. Morrison, Wildwood, MO (US); Steven L. Johnson, O'Fallon, IL (US)

(73) Assignee: Rawlings Sporting Goods Company, Inc., Fenton, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/976,957

(22) Filed: Oct. 12, 2001

(65) Prior Publication Data

US 2003/0073526 A1 Apr. 17, 2003

(51) Int. Cl.[7] ..... A63B 41/08
(52) U.S. Cl. ..... 473/604; 473/599
(58) Field of Search ..... 473/599, 604, 473/605, 607, 447; D21/713, 714

(56) References Cited

U.S. PATENT DOCUMENTS

| | | | | | |
|---|---|---|---|---|---|
| 1,187,029 | A | | 6/1916 | Beebout | |
| 1,705,096 | A | * | 3/1929 | Pierce | 473/599 |
| 1,863,170 | A | | 6/1932 | Scudder | |
| 1,890,566 | A | * | 12/1932 | Bartky | 473/599 |
| 2,078,141 | A | * | 4/1937 | Hesper | 473/599 |
| 2,091,455 | A | | 8/1937 | Riddell | |
| 2,129,238 | A | * | 9/1938 | Riddell | 473/604 |
| 2,352,872 | A | * | 7/1944 | Voit et al. | 473/605 |
| 2,494,796 | A | | 1/1950 | Brown | |
| 2,579,294 | A | * | 12/1951 | Brown | 473/605 |
| 2,609,202 | A | | 9/1952 | Winterbauer | |
| 2,623,747 | A | * | 12/1952 | Crowley | 473/605 |
| 3,119,618 | A | | 1/1964 | Molitor et al. | |
| 3,506,265 | A | * | 4/1970 | Yugi | 473/604 |
| 3,863,923 | A | | 2/1975 | Anderson | |
| D248,986 | S | | 8/1978 | Nakata | |
| 5,165,685 | A | * | 11/1992 | Hynes | 473/597 |
| 5,709,623 | A | | 1/1998 | Schwaner | |
| 5,931,752 | A | * | 8/1999 | Guenther et al. | 473/597 |
| 5,961,407 | A | | 10/1999 | Spiegel | |
| 6,099,423 | A | | 8/2000 | Ou | |
| 6,123,633 | A | | 9/2000 | Guenther et al. | |
| 6,200,239 | B1 | | 3/2001 | Kennedy, III et al. | |
| D462,732 | S | * | 9/2002 | Morrison et al. | D21/713 |

FOREIGN PATENT DOCUMENTS

| | | | | |
|---|---|---|---|---|
| GB | 266507 | * | 3/1927 | 473/FOR 148 |
| GB | 772449 | * | 4/1957 | 473/FOR 148 |

* cited by examiner

*Primary Examiner*—Steven Wong
(74) *Attorney, Agent, or Firm*—Stinson Morrison Hecker LLP

(57) ABSTRACT

A basketball game ball (20) comprising an outer cover (22) having nine to twelve cover panels and preferably ten cover panels separated by a plurality of channels (26) extending between and in abutment with the panels.

18 Claims, 2 Drawing Sheets

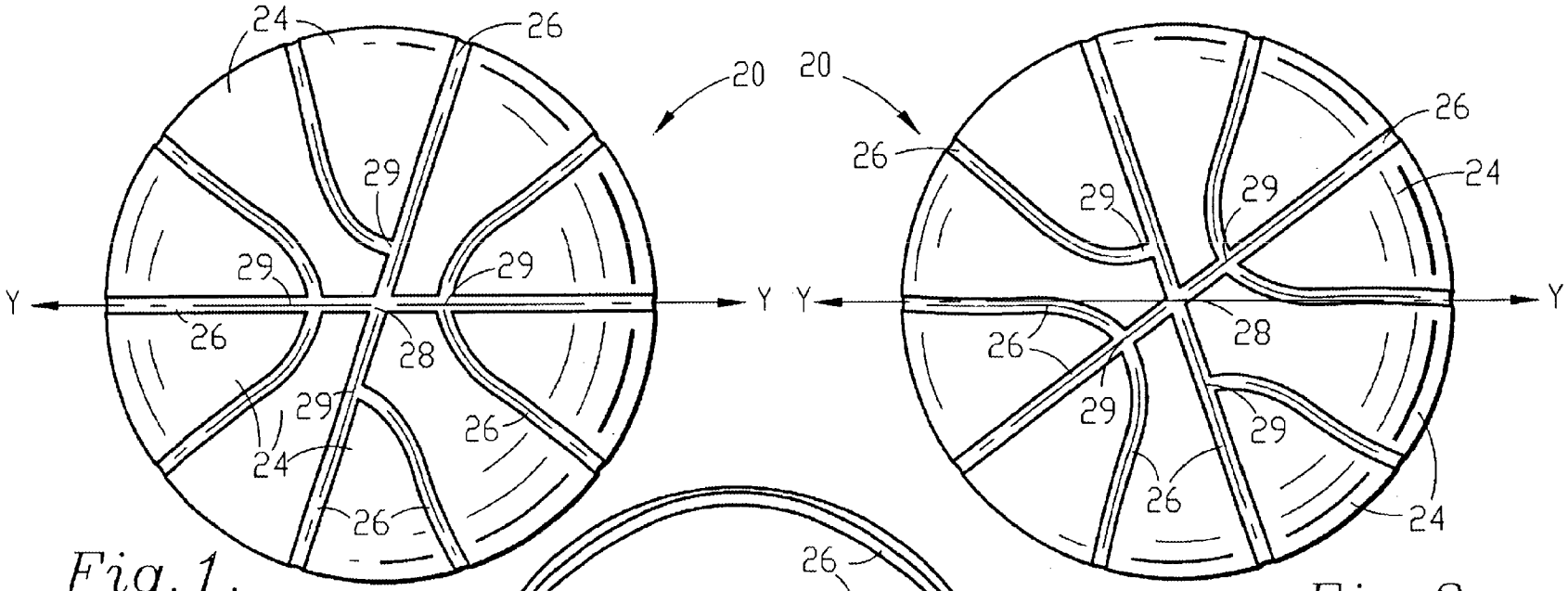
Fig. 1.
Fig. 2.
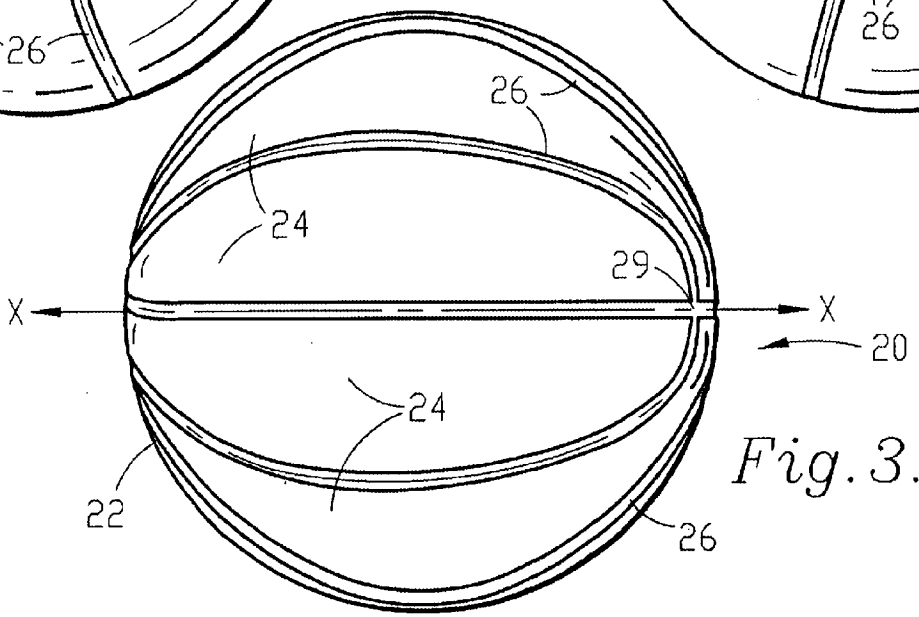
Fig. 3.

BASKETBALL HAVING NINE TO TWELVE COVER PANELS

BACKGROUND OF THE INVENTION

1. Field of the Invention

The present invention is generally directed to the field of game balls, and is more particularly directed to an improved basketball having an outer cover with an increased number of cover panels and channels over that of conventional basketballs to provide enhanced handling and shooting characteristics.

2. Description of Related Art

Conventional basketballs are round inflated balls having an inner bladder made of rubber or some other air impervious material to retain air in the inflated ball, and an outer cover or shell to enhance gripping and the overall durability of the ball. Basketballs typically come in three different sizes: (1) men's regulation size, 29½ inches in circumference; (2) women's regulation size, 28½ inches in circumference; and (3) junior regulation size, 27½ inches in circumference. Regardless of the size of the basketball, the outer cover generally comprises eight (8) elongate panels of leather, synthetic leather, rubber or other similar materials extending across the basketball from side to side. These panels are separated by channels which extend between each panel and intersect at intersection points on each side of the basketball.

While this conventional basketball configuration is useful, the industry is always striving to improve the playing characteristics and durability of basketballs.

BRIEF SUMMARY OF THE INVENTION

The present invention is directed to an improved basketball game ball having an outer cover or shell with at least nine and no more than twelve cover panels, wherein the panels are separated from one another by channels extending between and in abutting engagement with the cover panels. It is believed that a basketball with this increased number of cover panels has better gripping and handling characteristics than the eight paneled configurations previously known in the art, because a more optimum ratio of panel surface area to channel surface area is present on the outer cover. By increasing the number of cover panels, the overall size of at least some of these panels is reduced such that the distance between the channels is reduced and the amount of channel surface area is increased. Particularly for users with smaller hand sizes, the smaller spacing between the channels and greater overall channel surface area enables the user to better grip and control the basketball while dribbling, passing or shooting. Further, it is believed that balls with significantly more than twelve panels would include too much channel surface area, negating the benefits received from the increase number of panels and in addition, the basketball would lose its aesthetic appeal. Thus, the use of a basketball with nine, ten, eleven or twelve cover panels provides a distinct advance in the state of the art wherein the user's ability to grip the basketball is increased, while still maintaining the regulation sizes of a basketball game ball.

In a preferred embodiment, the cover panels comprise elongate strips of leather, synthetic leather, rubber or other suitable material extending across the basketball from side to side, wherein each panel has a maximum width at a center axis of the basketball. In this embodiment, the panels preferably have the same maximum width to provide a uniform distance between the channels, but it is envisioned that varying sizes of panels may be used. The channels extending between the panels intersect with at least one other channel on each side of the basketball to effectively separate the panels. Most preferably, some, but not all, of the channels intersect at a central intersection point on each side of the basketball and the remaining channels intersect with another channel at an intersection point distanced from the central intersection point. In this manner the width of the panels at each end is of sufficient size to maintain good adhesion to the ball.

In a most preferred embodiment, the basketball comprises a carcass and an outer cover. The carcass comprises a bladder, a layer of windings and a layer of cushioning material. The bladder is formed from a substantially air impervious material so as to retain air within the bladder when the ball is inflated. Next, thread is used to create a layer of windings around the inflated bladder to help maintain the round shape of the basketball. The layer of cushioning material is then attached to the layer of windings to provide a soft feel to the basketball. The outer cover comprises nine to twelve cover panels, most preferably ten cover panels, made from elongate strips of leather, synthetic leather, rubber or other materials known in the art. These panels are separated by channels made of rubber or other material known in the art extending between and fused or otherwise affixed to the panels. The cover panels and channels are secured to the carcass in a configuration resulting in a ratio of channel surface area to total surface area ranging from approximately 12 to 15%, most preferably 12 to 14% on a men's regulation sized ball.

BRIEF DESCRIPTION OF THE DRAWINGS

FIG. 1 is a right side plan view of the inflatable basketball game ball including a ten-panel configuration;

FIG. 2 is the left side plan view of the inflatable basketball game ball of FIG. 1;

FIG. 3 is a front plan view of the inflatable basketball game ball of FIG. 1;

DETAILED DESCRIPTION OF PREFERRED EMBODIMENT

Figure 5:
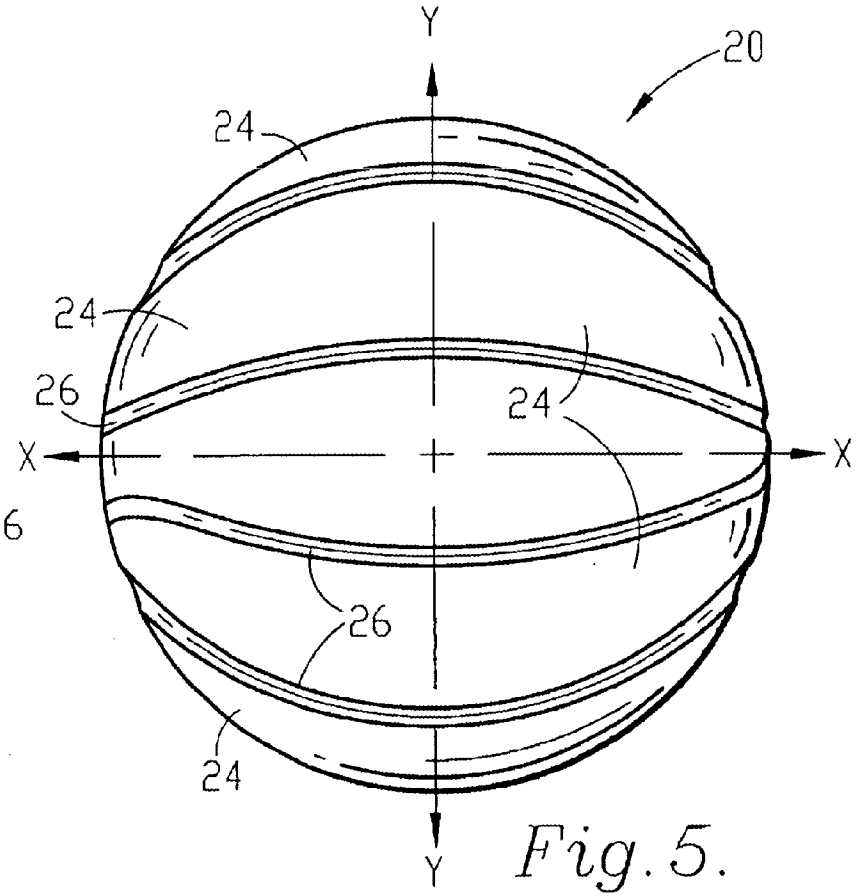
FIG. 5 is a bottom plan view of the inflatable basketball game ball of FIG. 1.
Figure 4:
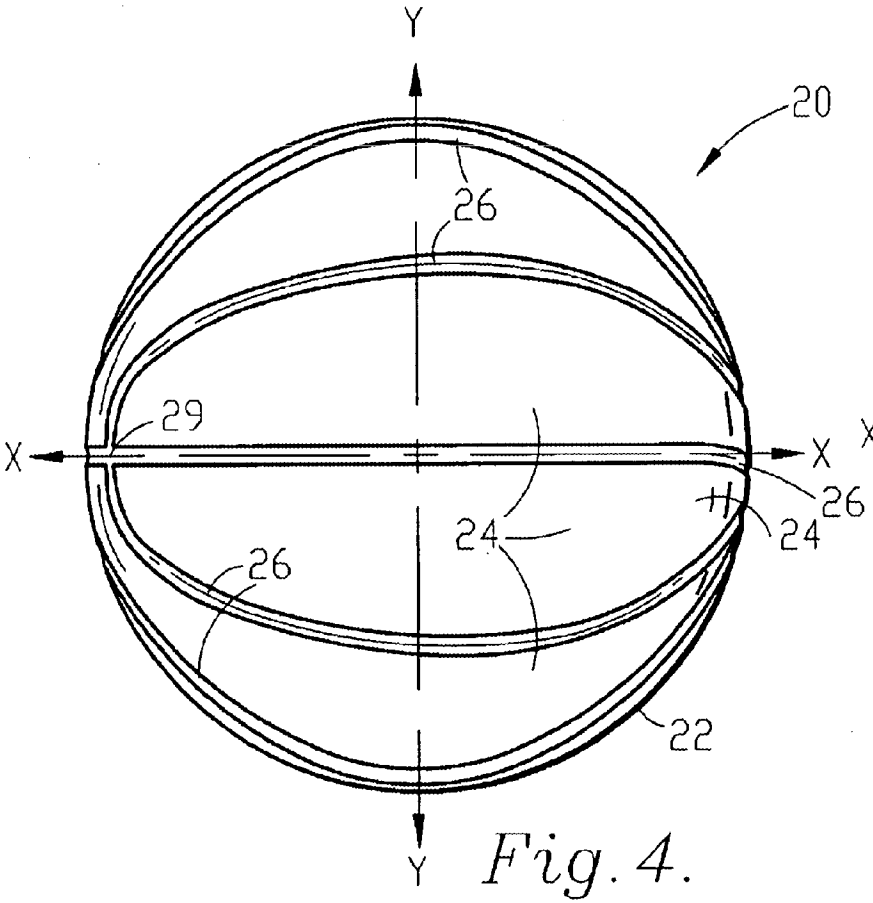
FIG. 4 is a top plan view of the inflatable basketball game ball of FIG. 1.

Referring initially to FIGS. 1 and 2, an inflatable basketball game ball including an outer cover 22 in accordance with a preferred embodiment of the present invention is generally designated by the reference numeral 20. Outer cover 22 consists of ten (10) cover panels 24 and a plurality of channels 26 that extend between and separate each panel. In accordance with the preferred embodiment shown in the drawings, cover panels 24 consist of elongated strips of material such as leather, synthetic leather, rubber or other materials now known or hereafter developed in the art having a suitable texture for enabling a user to grasp the basketball. The cover panels 24 are presented adjacent one another around the basketball with each panel extending longitudinally across the basketball and terminating on each side of the basketball. In this manner, the top and bottom of the basketball are substantially similar to one another each having five panels extending thereacross from side to side.

Channels 26 are positioned between and in abutting engagement with cover panels 24 so as to separate the cover panels. These channels may be made from any material now known or hereafter developed in the art for such purposes and are preferably formed of rubber that is fused or otherwise adhered to the outer edges of cover panels 24. Channels 26 preferably have a width ranging from 5.0 mm to 6.0 mm, most preferably 5.5 mm to 6.5 mm. Channels 26 also preferably have a concave cross-section such that the midpoint of each channel extends inwardly toward the interior of the basketball to enable better gripping of the ball along the channels.

In the preferred embodiment shown in drawings, the panels each have the same maximum width and arc length as they cross center axis y. This arc length is defined by measuring the angle between lines drawn from the midpoints of the two channels 26 abutting any given panel to the center of the ball. In this manner, regardless of the circumference of the ball, a basketball as shown in the drawings having ten panels of equal maximum width would have 36 degrees of arc length. For a basketball having nine panels, the arc length would instead be 40 degrees.

While the widest portions of the cover panels 24 have similar arc length, the cover panels are not all the same size and/or shape. The panels 24 are laid out so that channels 26 do not emanate or terminate together at a single point. Instead the cover panels 24 are designed such that four of the channels 26 intersect at a central intersection point 28 along center axis x on each side of the basketball. The remaining channels 26 intersect with other channels at intersection points 29 distanced from central intersection point 28. This configuration is preferred because it is anticipated that if all the channels met at a single intersection point on each side, the panel strips at each side would be very thin so as to lack good adherence and be prone to peeling away from the carcass during play. This configuration also provides a uniformity of feel to the user.

With the increased number of cover panels 24 in the present invention over that of conventional basketballs comes a corresponding number of increased channels 26 as well. The channels of a typical basketball provide the user with various surfaces on which to apply pressure in order to direct the ball when dribbling, passing or shooting the basketball. By increasing the number of channels 26, the user has an additional number of surfaces to assist the user with control of the basketball. The additional channels 26 take up a larger percentage of the surface area of a standard basketball in comparison to the channels of a standard eight panel basketball. The standard basketball size is defined as having a 29½ inch circumference for a men's ball, a 28½ inch circumference for a women's regulation ball, a 27½ inch circumference for a junior regulation ball.

A standard 29½ circumference basketball with 8 panels has a total surface area of around 278 square inches and a channel surface area of approximately 26.9 sq. in. such that the ratio of channel surface area to total surface area is approximately 9.7%. In the present invention, the overall channel surface area of a 29½ inch circumference ball preferably ranges from 29 to 37 square inches, most preferably 30 to 36 square inches, and the ratio of channel surface area to total surface area ranges from 10.5 to 14%, most preferably 11 to 13%.

A standard 28½ circumference basketball with 8 panels has a total surface area of around 254 square inches and a channel surface area of approximately 25.5 sq. in. such that the ratio of channel surface area to total surface area is approximately 10.0%. The overall channel surface area of a 28½ circumference ball in accordance with the present invention preferably ranges from 27 to 35 square inches, most preferably 28 to 34 square inches, and the ratio of channel surface area to total surface area ranges from 10.5 to 14%, most preferably 11 to 13%.

A standard 27½ circumference basketball with 8 panels has a total surface area of around 243 square inches and a channel surface area of approximately 24.1 sq. in. such that the ratio of channel surface area to total surface area is approximately 9.9%. The overall channel surface area of a 27½ circumference ball in accordance with the present invention preferably ranges from 26 to 33 square inches, most preferably 27 to 32 square inches, and the ratio of channel surface area to total surface area ranges from 10.5 to 14%, most preferably 11 to 13%.

A basketball made in accordance with this invention may be made by any method now known or later developed in the art so long as the ball has an outer cover with nine to twelve cover panels separated by channels in abutting engagement with the panels. Various conventional methods known for making basketballs are described in U.S. Pat. Nos. 2,494,796; 3,119,618; 5,681,233; and 6,200,239 which are incorporated herein by reference.

In a most preferred embodiment, basketball 20 includes an inner carcass that is covered by outer cover 24. The inner carcass preferably comprises a bladder, a layer of windings and a layer of cushioning material. The bladder is preferably spherical and made from a material that is substantially impervious to air. Most preferably, the bladder is made of rubber for good retention of air under pressure. In the manufacturing process, the bladder may be inflated and placed in a curing mold to cure the bladder material into the desired shape. Once the bladder has been cured, it is typically covered by winding a reinforcing thread around the bladder to form a layer of windings. The layer of windings assists in maintaining the size and shape of the ball when inflated and during use.

While not required, a layer of cushioning material is preferably secured to the wound bladder. The cushioning material softens the feel of the basketball by facilitating the depression of the outer cover when the ball is inflated so that the ball may be more readily gripped. The cushioning material may be formed of a single layer or plurality of layers of any material commonly known and used in the art. Once the cushioning material and the wound bladder have been secured, together they are called the carcass.

Cover panels 24 may then be secured to the carcass by applying adhesive to both the carcass and the cover panels 24. The cover panels 24 are placed on the carcass in a desired pattern. Located in between the cover panels 24 are the channels 26. The channels are preferably formed from strips of material, such as rubber, that are positioned between the cover panels 24 and secured to the carcass. Finally, the inflated carcass, cover panels and strips of material in between the panels may be placed into a mold and heated to assist the bonding process.

While the preferred embodiment shown in the drawings includes ten (10) panels, it is anticipated that a basketball in accordance with the present invention may have an outer cover 22 comprising a plurality of panels ranging from nine (9) to twelve (12) panels. Furthermore, the size and shape of each of the cover panels 24 and the corresponding number of channels 26 may vary without departing from the scope of the invention, albeit to provide uniformity of appearance and feel for the user, it is preferable that the panels 24 be configured to form a substantially uniform pattern. A uniform pattern is desirable to provide balance and symmetry for enhanced handling characteristics.

While it is preferred that the maximum width of the panels be substantially similar at the central y axis, it should be understood that the width may vary from one panel to the next. For instance, the panels could alternate between a wide panel and a narrow panel for ten or twelve paneled balls. Alternatively, the panels could also alternate between a wide panel followed by two narrow panels for a total of three wide panels and six narrow panels on a nine paneled ball. There are numerous possible combinations of narrow panels, wide panels or panels with sizes in between that can be used in the nine to twelve paneled basketballs.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

What is claimed and desired to be secured by Letters Patent is as follows:

1. An inflatable basketball game ball comprising a right side, a left side, and an outer cover having at least nine and no more than twelve panels, wherein each of said panels extends longitudinally across the basketball and terminates on each of said sides, and wherein each of said panels is separated by one or more channels extending between and abutting said panels, and wherein no more than four of said channels terminate together at a single point.

2. The inflatable basketball game ball of claim 1, wherein said outer cover has at least ten panels and no more than eleven panels.

3. The inflatable basketball game ball of claim 1, wherein said outer cover has ten panels.

4. The inflatable basketball game ball of claim 3, wherein each of said panels has a maximum width that is substantially the same for each panel.

5. The inflatable basketball game ball of claim 1, further including an inner carcass that is covered by said outer cover.

6. The inflatable basketball game ball of claim 1, wherein each of said channels intersect with at least one other of said channels on the right side and the left side of the basketball.

7. The inflatable basketball game ball of claim 6, wherein at least two of said channels intersect at a central intersection point on the right side and at least two of said channels intersect at a central intersection point on the left side, each of said central intersection points lie along a center axis of said basketball.

8. The inflatable basketball game ball of claim 7, wherein at least one of said channels intersects with another of said channels on the right side at an intersection point distanced from the central intersection point on the right side, and at least one of said channels intersects with another of said channels on the left side at an intersection point distanced from the central intersection point on the left side.

9. The inflatable basketball game ball of claim 1, wherein the basketball has a circumference of about 29½ inches, and wherein a surface area of said channels comprises about 10.5–14% of a total surface area of the basketball.

10. The inflatable basketball game ball of claim 9, wherein the channel surface area is 11–13% of said total surface area.

11. The inflatable basketball game ball of claim 1, wherein the basketball has a circumference of about 28½ inches, and wherein a surface area of said channels comprises about 10.5–14% of a total surface area of the basketball.

12. The inflatable basketball game ball of claim 11, wherein the channel surface area is 11–13% of said total surface area.

13. The inflatable basketball game ball of claim 1, wherein the basketball has a circumference of about 27½ inches, and wherein a surface area of said channels comprises about 10.5–14% of a total surface area of the basketball.

14. The inflatable basketball game ball of claim 13, wherein the channel surface area is 11–13% of said total surface area.

15. A basketball game ball comprising:

an inner bladder for retaining air; and an outer cover enclosing said inner bladder, wherein said outer cover comprises a left side and a right side, and wherein said outer cover has ten panels separated by one or more channels extending between and in abutting engagement with said panels, each of said channels extending longitudinally across said outer cover and terminating on said left side and said right side of said outer cover and wherein at least two of said cover panels are different in size and shape when compared with the remaining cover panels.

16. A method of constructing an inflatable basketball game ball comprising the steps of:

providing a substantially air impervious bladder for retaining air;

covering said bladder with at least one layer of windings and at least one layer of cushioning to form a carcass, wherein said carcass has a left side and a right side;

securing nine to twelve cover panels around said carcass such that said cover panels are adjacent one another, extend longitudinally across said carcass and terminate on each of said sides of said carcass, wherein at least two of said cover panels are different in size and shape, and wherein said cover panels are made from a material selected from the group consisting of leather, artificial leather or rubber to said carcass; and securing strips of rubber between said cover panels to form concave channels separating said cover panels.

17. The method of claim 16, wherein ten cover panels are secured to said carcass.

18. The method of claim 16, wherein each of said cover panels have substantially the same maximum width.

* * * * *